United States Patent [19]

Lombardo

[11] Patent Number: 4,840,306

[45] Date of Patent: Jun. 20, 1989

[54] FOLD-OVER MAILER WITH SIDE-OPEN RETURN ENVELOPE WITH SLITTABLE EDGE

[75] Inventor: Leo Lombardo, Manchester, NH.

[73] Assignee: Moore Business Forms, Inc., Grand Island, N.Y.

[21] Appl. No.: 234,579

[22] Filed: Aug. 22, 1988

[51] Int. Cl.[4] ..... B65D 27/06; B65D 27/10; B65D 27/34

[52] U.S. Cl. ..... 229/73; 229/69; 206/610

[58] Field of Search ..... 229/73, 69; 206/610; 493/216

[56] References Cited

U.S. PATENT DOCUMENTS

| | | | |
|---|---|---|---|
| 1,401,324 | 12/1921 | Dority et al. | 229/73 |
| 2,759,658 | 8/1956 | Sawdon | 229/73 |
| 2,777,631 | 1/1957 | Zalkind | 229/73 |
| 2,855,138 | 10/1958 | Hopkin | 229/72 |
| 3,111,336 | 11/1963 | Schumacher | 229/73 |
| 3,288,350 | 11/1966 | Kushner | 229/70 |
| 3,472,444 | 10/1969 | Aliff, Jr. et al. | 229/73 |
| 3,580,489 | 5/1971 | Oettinger | 229/70 |
| 3,652,007 | 3/1972 | MacDougall | 229/73 |
| 3,802,618 | 4/1974 | Wiessner | 229/73 |
| 3,981,435 | 9/1976 | Johnsen | 229/73 |
| 4,044,942 | 8/1977 | Sherwood | 229/73 |
| 4,524,903 | 6/1985 | Vath | 229/73 |
| 4,638,940 | 1/1987 | Skokos et al. | 229/73 |
| 4,709,850 | 12/1987 | Wagner | 229/73 |
| 4,756,468 | 7/1988 | Jenkins | 229/73 |

*Primary Examiner*—Stephen Marcus
*Assistant Examiner*—Jes F. Pascua
*Attorney, Agent, or Firm*—Nixon & Vanderhye

[57] ABSTRACT

The mailer includes a sheet folded medially to form two plies secured one to another about their marginal edges with an intermediate ply secured about three of its four edges to one of the plies. The remaining edge of the intermediate ply forms an opening for the return envelope defined by the intermediate ply and the one ply. To enable the edge of the return envelope to be slit by automatic mail opening equipment, the intermediate ply is reversely folded along the one edge and adhesively secured to the one ply along the flap. This enables a slit to be formed very close to the edge of the return envelope whereby the return envelope may be opened without interference from the glue line securing the intermediate and one plies one to the other.

20 Claims, 2 Drawing Sheets

FOLD-OVER MAILER WITH SIDE-OPEN RETURN ENVELOPE WITH SLITTABLE EDGE

BACKGROUND AND SUMMARY OF INVENTION

The present invention relates to mailers of a type having an integral return envelope and particularly relates to mailers wherein the return envelope is specifically configured in the mailer to enable the return envelope to be opened by automatic letter opening equipment.

Many mailers have heretofore been constructed of multiple paper plies glued one to the other along their marginal edges. Certain of the edges form marginal tear strips such that the recipient of the mailer may tear off the tear strips and open the mailer. When open, the mailer oftentimes includes an integral return envelope formed by adjacent plies which are secured one to the other along their margins. One of the margins is usually left unsealed and a flap is provided on one of the plies which may be folded over and adhesively secured to the other ply to seal the return envelope.

In such constructions, the margins of the return envelope are secured one to the other along their opposing inside faces by lines of adhesive. Those lines of adhesive have a marginal depth, for example, on the order of ¼ inch or more and extend about the periphery of the return envelope. Automatic letter opening equipment, however, is set to form a slit in the return envelope, usually no more than 1/16 of an inch from the edge of the return envelope. Consequently, when return envelopes of the prior art mailers previously described are run through the automatic letter opening equipment, the slitting or cutting action does not remove enough of the envelope to clear the marginal adhesive line. That is, sufficient adhesive remains between the opposed faces of the plies of the return envelope to maintain the margins secured one to the other notwithstanding that a portion of the adhesively-secured margins has been removed.

It is not feasible to set the automatic letter opening equipment to form a slit further inwardly of the edge of the envelope than about 1/16 inch. This is because the automatic letter opening equipment is also used to automatically open conventional envelopes. If set to form a slit spaced further from the edge of the envelope, it would also slit the contents of the envelope as well as possibly require in use discrimination between conventional envelopes and return envelopes used in mailers. As a consequence, it has not heretofore been feasible to use automatic letter opening equipment with a return envelope formed as an integral part of a mailer where the margins of the return envelope are secured one to the other by a line of adhesive having a depth greater than the distance the automatic letter opening equipment will form a slit from the edge of the envelope.

The present invention provides a mailer with an integral return envelope which minimizes or eliminates the foregoing and other disadvantages of return envelopes for mailers and provides a novel and improved mailer with an integral return envelope constructed specifically for use with automatic letter opening equipment. According to the present invention, there is provided a mailer formed of multiple plies of sheet material, e.g., paper, which may be adhesively secured one to the other along their margins to enclose remittance slips, statements and the like, and also to enclose, at least in part, a return envelope formed integrally with the mailer. More specifically, the return envelope may be formed in part by an intermediate ply secured along its margins to one of the outer plies. For example, where generally rectilinear mailers and return envelopes are provided, the intermediate ply may be secured along three of its margins to one of the outer plies. The fourth margin may be left unsealed to form an opening for the return envelope. Two of the margins of the intermediate ply may be adhesively secured to corresponding opposed margins of the outer ply. The third margin of the intermediate ply is, according to the present invention, reversely folded over onto itself to form a flap. Adhesive is applied between the flap and the outer ply such that the adhesive securement between the intermediate and outer plies lies between the flap and outer ply. Thus, the interior of the return envelope extends outwardly to the foldline of the flap. This enables the edge of the return envelope to be slit, for example, by automatic letter opening equipment, along a line spaced only slightly inwardly of the edge of the envelope formed by the foldline of the flap. In this manner, tee automatic letter opening equipment may be set in conventional fashion, i.e., to remove a 1/16-inch strip from the edge of the envelope, with the assurance that the slit will open the return envelope. That is, the slit will be formed along the flap and the intermediate ply inwardly of the foldline to form an opening for the envelope and also along the glue line between the flap and the outer ply. Thus, the adhesive or glue line is to one side of the opening and does not interfere with or maintain the return envelope sealed once the slit has been formed.

In the particular mailer hereof, the outer plies are preferably formed from a single sheet of paper folded substantially medially. Tear strips are provided along the margins of the mailer such that, upon their removal, one ply may be removed from the other ply, thereby exposing the return envelope for use. It will be appreciated from the foregoing description that the flap and its adhesive securement to the outer ply is inset from the adjacent adhesively secured margin of the two outer plies. Consequently, upon removal of the one ply by the recipient, the recipient may also remove the remaining strip of the other ply along a perforation line provided adjacent the edge of the return envelope, i.e., the foldline of the flap. Preferably, the outer ply adjacent the open end of the return envelope has a closure flap carrying either a rewettable or pressure-sensitive adhesive whereby the closure flap can be folded and sealed to the return envelope.

In a preferred embodiment of the present invention, there is provided a mailer having a return envelope, comprising first and second paper plies, means about the margins of the plies for releasably securing the plies one to the other, and a third paper ply disposed between the first and second plies and having discrete margins. Means are provided about the margins of the third ply for securing the third ply and one of the first and second plies one to the other whereby the intermediate ply and the one ply form a return envelope. Means are also provided defining an opening for the return envelope along a margin of the third ply, one of the margins of the third ply being reversely folded along a foldline to form a flap disposed between the third ply and the one ply and a line of adhesive disposed between the flap and the one ply to secure the third ply and the one ply one to the other along the one margin whereby an edge portion of the return envelope and including the flap may be slit adjacent the foldline and along the adhesive line to open the return envelope.

In another preferred embodiment of the present invention, there is provided a two-way mailer, comprising first, second and third paper plies, means for releasably securing the first ply and one of the second and third plies one to the other such that the first ply may be removed from the mailer, means including portions of the second and third plies defining a return envelope, one of the second and third ply portions having a margin folded about a foldline to form a flap disposed between the second and third ply portions adjacent an edge of the return envelope and means between the flap and the other of the second and third ply portions for securing the flap and the other ply portion one to the other whereby the flap and the one of said second and third ply portions form opposed parts of the return envelope with the foldline forming an edge of the return envelope.

In a still further preferred embodiment of the present invention, there is provided a mailer having a return envelope, comprising a plurality of paper plies including first and second paper plies forming the outer plies of the mailer and means about the margins of the plies for releasably securing the first and second plies one to the other. The plurality of paper plies include an intermediate ply disposed between the first and second plies and have discrete margins. Means are provided for securing the intermediate ply and one of the plurality of plies one to the other whereby the intermediate ply and the one ply form a return envelope. Means are also provided cooperable between the intermediate ply and the one ply defining an opening for the return envelope along a margin of the intermediate ply, one of the margins of the intermediate ply being reversely folded along a foldline to form a flap disposed between the intermediate ply and the one ply and a line of adhesive disposed between the flap and the one ply to secure the intermediate ply and the one ply one to the other along the one margin whereby an edge portion of the return envelope and including the flap may be slit adjacent the foldline and along the adhesive line to open the return envelope.

Accordingly, it is a primary object of the present invention to provide a novel and improved mailer with return envelope specifically constructed to facilitate its use with automatic letter opening equipment.

These and further objects and advantages of the present invention will become more apparent upon reference to the following specification, appended claims and drawings.

BRIEF DESCRIPTION OF THE DRAWING FIGURES

FIG. 1 is a plan view of a mailer with integral return envelope constructed in accordance with the present invention;

FIG. 2 is a plan view of a single sheet of material from which the outer plies of the mailer illustrated in FIG. 1 may be formed, together with an intermediate sheet which, in final assembly, forms part of the return envelope, the single sheet being illustrated as part of a continuous business form in the manufacturing process; and FIG. 2A is a cross-sectional view thereof taken generally about on line 2A—2A in FIG. 2.

DETAILED DESCRIPTION OF THE DRAWING FIGURES

Reference will now be made in detail to the present preferred embodiment of the invention, an example of which is illustrated in the accompanying drawings.

Figure 2:
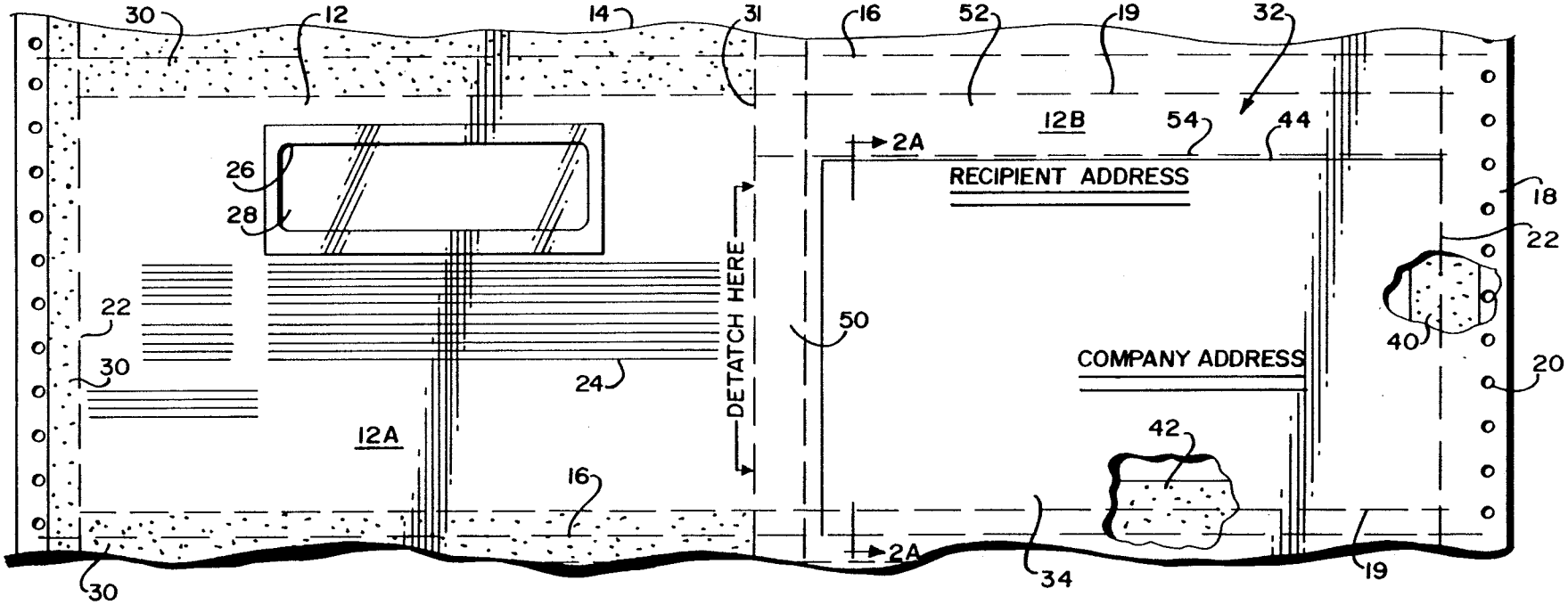

Referring now to the drawing figures, there is illustrated a mailer, generally designated 10, constructed in accordance with the present invention and which includes a first sheet of material 12, e.g., paper, which, as illustrated in FIG. 2, is part of a continuous business form 14. As illustrated in FIG. 2, each sheet 12 is connected to adjacent sheets 12 in form 14 by transversely extending lines of perforations 16. Marginal tear strips 18 are provided along the opposite side margins of continuous form 14 and have tractor openings 20 disposed at longitudinal spaced positions therealong to facilitate use of the continuous form in conventional printers and the like. Each marginal tear strip 18 is connected to the sheet 12 by longitudinally extending lines of perforations 22.

To form the individual mailers 10, each sheet 12 is separated along the transversely extending lines of perforation 16 from adjacent sheets, the marginal tear strips 18 being retained on each sheet for use with the first mailing, as will become clear from the ensuing description. It will be appreciated that, as illustrated in FIG. 2, the transverse lines of perforations 16 extend across the marginal strips 18. Additional transversely extending lines of perforations 19 are provided and are spaced longitudinally inwardly of lines of perforations 16 to form transverse tear strips 21A and 21B (FIG. 1), as will become clear from the ensuing description.

Various information may be computer-generated and printed on the various parts of sheet 12. For example, information blocks, designated 24, may be provided on the face of sheet 12 such that a portion of sheet 12 may form a remittance slip containing charge or credit descriptions, dates, admission numbers, date of statement and similar type information for billing or other purposes. Additionally, the sheet may be provided with a die-cut window 26 optionally having a transparent sheet 28, i.e., glassing, marginally secured about the margin of the die-cut window 26. In the final form of the mailer, it will be appreciated that additional sheets may be disposed within the mailer and have address information thereon for viewing through die-cut window 26. Heat-sealable adhesive 30 is provided about the outer margins of panel 12A, for example, between the transverse lines of perforations 16 and 19 and along its longitudinal tear strip 18. As described hereinafter, it will be appreciated that the sheet 12 is folded about a medial longitudinally extending foldline 31 to form the outer panels or plies 12A and 12B of the mailer and which plies are marginally secured one to the other by the lines of adhesive 30, it being appreciated from the ensuing description that certain of the marginal portions of panels 12A and 12B are secured one to the other with one or more plies being intermediate those marginal portions.

The mailer also includes a return envelope, generally designated 32. The envelope 32 is formed of two plies, one of the plies constituting a portion of the outer ply 12B of sheet 12. The other ply, which constitutes an intermediate ply when the mailer is in final form, as illustrated in FIG. 1, comprises a third generally rectilinear ply 34 in the form of a planar sheet having three of its marginal portions secured to the outer ply 12B.

One of the marginal portions of the third or intermediate ply has a line of adhesive 40 which overlies a longitudinal margin of sheet panel 12B to form part of the longitudinal tear strip 18. Another of the marginal portions of the third ply has a line of adhesive 42 which overlies a transverse margin of sheet panel 12B to form a part of the transverse tear strips 21A. The lines of adhesive 40 and 42 are also inset from and straddle respective lines of perforations 22 and 19 such that marginal portions of the intermediate ply 34 of return envelope 32 inset from transverse perforation lines 19 and 22 are secured to the underlying ply 12B. Ply 34 is not secured to the underlying ply 12B at the side thereof adjacent foldline 31 and therefore its end edge together with underlying ply 12B adjacent that edge forms an opening to the return envelope.

Figure 2A:
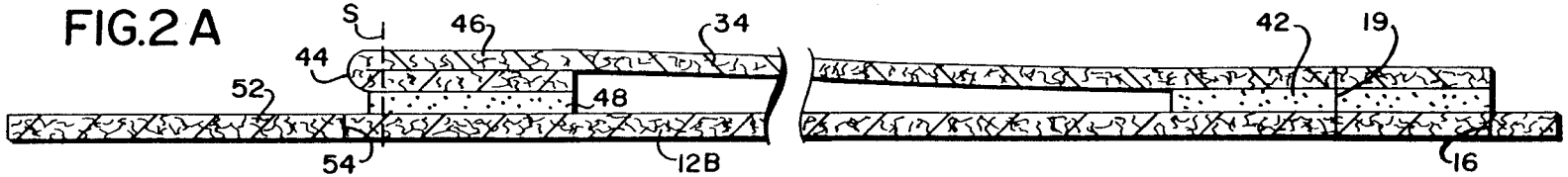

In accordance with the present invention, the other long edge of the generally rectilinear return envelope is configured for slitting by automatic letter opening equipment. In order for the slit to be formed as close as possible to the longitudinally extending edge 44 of the return envelope, yet without having any adhesive maintaining the envelope closed after slitting, the fourth and final margin of the intermediate or third ply 34 forming the return envelope 32 is reversely folded inwardly onto itself about foldline 44 to form a flap 46, as best illustrated in FIG. 2A. To secure the flap to the underlying ply 12B, a line of adhesive 48 is provided between flap 46 and ply 12B. It will be appreciated, as seen in the righthand portion of FIG. 2A, that the line of adhesive 42 secures the opposed marginal faces of ply 12B and ply 34. On the other side of the return envelope, flap 46 is interposed between the line of adhesive 48 and ply 34. Consequently, it will be seen in FIG. 2A that a slit S formed longitudinally along the margin of the return envelope, that is, along the left margin, as illustrated in FIG. 2A, would remove edge portions of ply 34 and flap 46 slightly inwardly of foldline 44, a portion of the adhesive 48 and the remaining portion of ply 12B. Thus, slit S may be provided as close to edge 44 as in the conventional envelope flap, enabling automatic letter opening equipment to open this return envelope.

Figure 1:
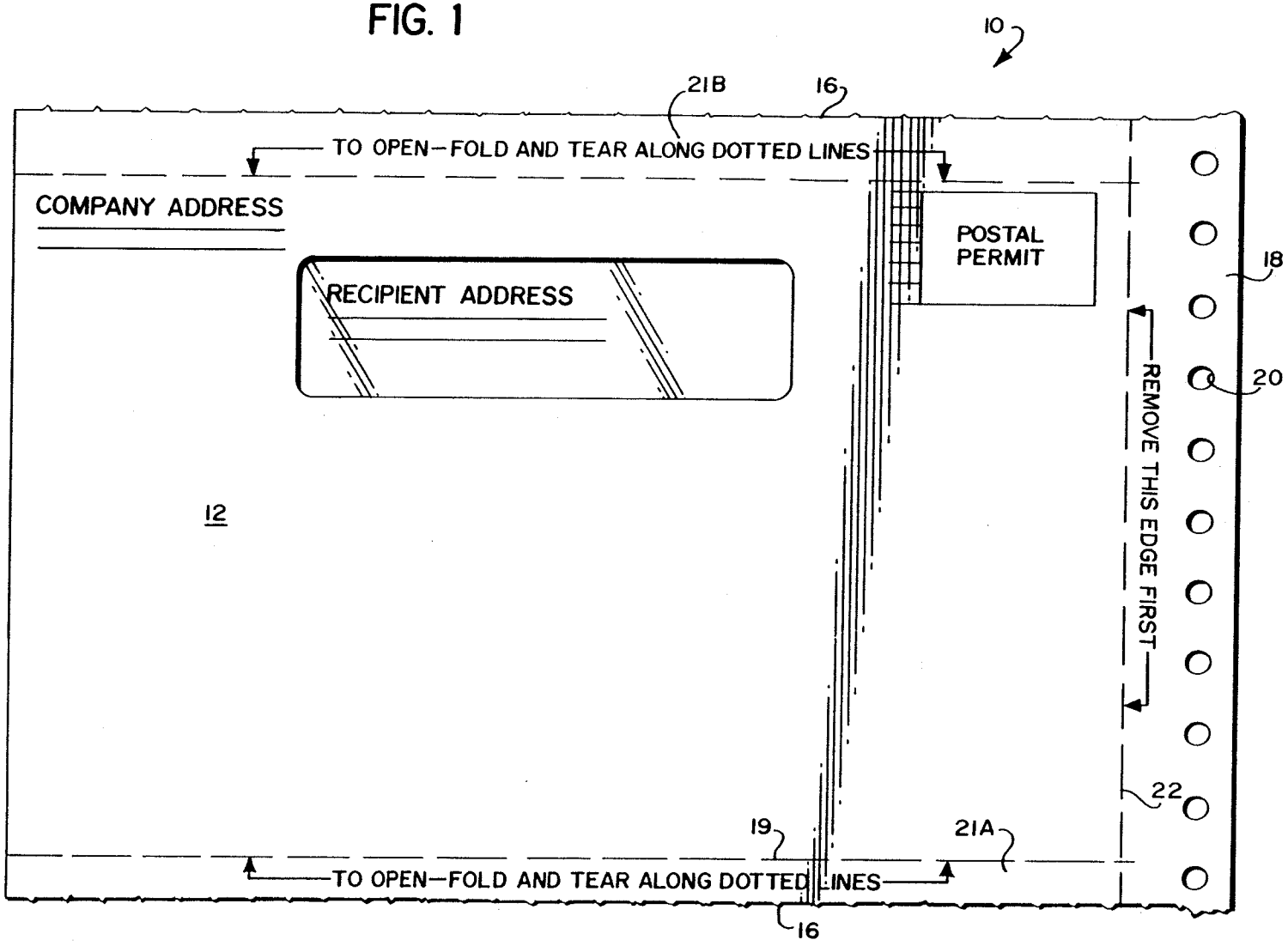

From a review of FIGS. 2 and 2A, it will be appreciated that the rectilinear dimensions of the return envelope are smaller than the rectilinear dimensions of the mailer when folded into final configuration, as illustrated in FIG. 1. Because the end of ply 34 terminates short of foldline 31, there is provided a closure flap 50. Closure flap 50 may have a rewettable adhesive or pressure-sensitive adhesive therealong for purposes of sealing the envelope when flap 50 is folded over onto the face of ply 34. If pressure-sensitive adhesive is used, a removable transparent tape may be provided to overlie the pressure-sensitive adhesive. The portion of the underlying ply 12B outside the confines of the return envelope, forms a strip 52 which may be detached from ply 12B along a perforation line 54, formed in ply 12B. Perforation line 54 extends closely adjacent edge 42 of the return envelope.

To assemble the mailer, sheet 12, including its marginal tear strips 18, is segregated from adjoining sheets. The sheet 12 is folded medially along foldline 31 and the marginal adhesive is activated, e.g., by heating, to secure the three margins of the mailer one to the other such that the plies 12A and 12B form opposite sides of the mailer. The third or intermediate ply 34 forming part of the return envelope is, of course, disposed within the mailer between plies 12A and 12B. When the recipient receives the mailer, the transversely extending tear strips 21A and 21B along opposite longitudinal edges of the mailer illustrated in FIG. 1, as well as the registering marginal tear strips 18, may be removed by tearing along the registering lines of perforations. Additionally, ply 12A may be removed from ply 12B by tearing along the perforation line which defines foldline 31. Further, strip 52 is removable from ply 12B by tearing along the line of perforations 54. Note that, after ply 12A is removed, three of the margins of ply 34 of the return envelope remain secured by adhesive lines 40, 42 and 48 to the underlying ply 12B and that the return envelope is open adjacent the flap 50. After the appropriate materials, e.g., a remittance statement and a check, have been inserted into the return envelope, the flap 50 may be folded over and sealed to the outer face of ply 34, either by wetting the rewettable glue or removing the transfer tape and pressing the flap against the outer face of the return envelope.

When the return envelope is received, it may be disposed in an automatic letter opening machine such that the return envelope is opened along its longitudinal edge 42. The automatic letter opening machine forms a slit spaced inwardly about 1/16 of an inch from edge 42 and thus opens return envelope 32 with the opening being defined between ply 34 and flap 46. The flap 46 remains after slitting secured to the underlying ply 12B by the line of adhesive 48. Thus, even though only a portion of the line of adhesive 48 has been removed by the slitter, the adhesive does not interfere with opening of the return envelope, inasmuch as the opening is provided between portions of the return envelope which are not adhesively secured one to one the other.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A mailer having a return envelope, comprising first and second paper plies;

means about the margins of said plies for releasably securing said plies one to the other;

a third paper ply disposed between said first and second plies and having discrete margins;

means about the margins of said third ply for securing said third ply and one of said first and second plies one to the other whereby said intermediate ply and said one ply form a return envelope;

means defining an opening for said return envelope along a margin of said third ply;

one of the margins of said third ply being reversely folded along a foldline to form a flap disposed between said third ply and said one ply and a line of adhesive disposed between said flap and said one ply to secure said third ply and said one ply one to the other along said one margin whereby an edge portion of said return envelope and including said flap may be slit adjacent said foldline and along the adhesive line to open the return envelope.

2. A mailer according to claim 1 wherein said one ply constitutes a carrier web for the return envelope, said third ply having an extent in one direction less than the extent of said carrier web in said one direction, said flap and said one ply being adhesively secured one to the other at a location inset from a margin of said carrier web such that the carrier web extends in one direction beyond said third ply to define a carrier web strip, said carrier web strip and a corresponding margin of said first ply being secured one to the other by said releasable securing means, and a line of perforations along said carrier web adjacent said foldline such that, upon removal of the first ply from the second ply, said strip can be removed from said carrier web along said line of perforations.

3. A mailer according to claim 1 wherein said releasable securing means includes lines of adhesive between the margins of said first and second plies outwardly of the means securing the margins of said third ply and said one ply one to the other.

4. A mailer according to claim 3 wherein at least two of the margins of said third ply are disposed between corresponding margins of said first and second plies, said lines of adhesive lying on opposite sides of said two margins of said third ply, and registering lines of perforations along the two margins of said third ply and the corresponding margins of said first and second plies inset to form tear strips along said margins.

5. A mailer according to claim 1 wherein said first and second plies comprise a single sheet of material folded about a foldline such that said plies lie in register one with the other with said third ply therebetween, said return envelope opening being disposed adjacent to but spaced from the foldline in said sheet such that said one ply extends from said envelope opening to said foldline to define a closure flap for said return envelope.

6. A mailer according to claim 5 wherein said closure flap has a pressure-sensitive adhesive therealong and a removable transfer tape overlying said pressure-sensitive adhesive whereby, upon removal of the tape, said closure flap may be folded and adhesively secured to the face of said third ply opposite said one ply to seal said return envelope.

7. A two-way mailer, comprising;

first, second and third paper plies;

means for releasably securing said first ply and one of said second and third plies one to the other such that the first ply may be removed from the mailer;

means including portions of said second and third plies defining a return envelope;

one of said second and third ply portions having a margin folded about a foldline to form a flap disposed between said second and third ply portions adjacent an edge of said return envelope and means between said flap and the other of said second and third ply portions for securing said flap and said other ply portion one to the other whereby said flap and said one of said second and third ply portions form opposed parts of said return envelope with said foldline forming an edge of said return envelope.

8. A mailer according to claim 7 wherein the latter securing means includes a line of adhesive between said flap and said other of said second and third ply portions.

9. A mailer according to claim 8 wherein said one of said second and third plies has non-folded additional margins and lines of adhesive between said additional margins and said other ply portion for securing said second and third plies one to the other.

10. A mailer according to claim 7 wherein said one ply constitutes a carrier web for the return envelope, said third ply having an extent in one direction less than the extent of said carrier web in said one direction, said flap and said one ply being adhesively secured one to the other at a location inset from a margin of said carrier web such that the carrier web extends in one direction beyond said third ply to define a carrier web strip, said carrier web strip and a corresponding margin of said first ply being secured one to the other by said releasable securing means, and a line of perforations along said carrier web adjacent said foldline such that, upon removal of the first ply from the second ply, said strip can be removed from said carrier web along said line of perforations.

11. A mailer according to claim 7 wherein said releasable securing means secures said first and second plies one to the other, said first and second plies comprising a single sheet of material folded about a foldline such that said first and second plies lie in register one with the other with said third ply therebetween, said return envelope having an opening defined between said second and third plies and disposed adjacent to but spaced from the foldline in said sheet such that said one ply extends from said envelope opening to said foldline to define a closure flap for said return envelope.

12. A mailer according to claim 11 wherein said closure flap has a pressure-sensitive adhesive therealong and a removable transfer tape overlying said pressure-sensitive adhesive whereby, upon removal of the tape, said closure flap may be folded and adhesively secured to the face of said third ply opposite said one ply to seal said return envelope.

13. A mailer according to claim 11 wherein said closure flap has a rewettable adhesive therealong whereby said closure flap may be folded and adhesively secured to the face of said third ply opposite said one ply to seal said return envelope.

14. A mailer having a return envelope, comprising:

a plurality of paper plies including first and second paper plies forming the outer plies of said mailer;

means about the margins of said plies for releasably securing said first and second plies one to the other;

said plurality of paper plies including an intermediate ply disposed between said first and second plies and having discrete margins;

means for securing said intermediate ply and one of said plurality of plies one to the other whereby said intermediate ply and said one ply form a return envelope;

means cooperable between said intermediate ply and said one ply defining an opening for said return envelope along a margin of said intermediate ply;

one of the margins of said intermediate ply being reversely folded along a foldline to form a flap disposed between said intermediate ply and said one ply and a line of adhesive disposed between said flap and said one ply to secure said intermediate ply and said one ply one to the other along said one margin whereby an edge portion of said return envelope and including said flap may be slit adjacent said foldline and along the adhesive line to open the return envelope.

15. A mailer according to claim 14 wherein said one ply constitutes one of said first and second plies.

16. A mailer according to claim 14 wherein said intermediate ply has an extent in one direction less than the extent of said one ply in said one direction, said flap and said one ply being adhesively secured one to the other at a location inset from a margin of said one ply such that said one ply extends in one direction beyond said intermediate ply to define a strip, and a line of perforations along said one ply adjacent said foldline such that said strip can be removed from said one ply along said line of perforations.

17. A mailer according to claim 16 wherein said one ply constitutes one of said first and second plies.

18. A mailer according to claim 14 wherein said releasable securing means includes lines of adhesive between the margins of said first and second plies outwardly of the means securing the margins of said intermediate ply and said one ply one to the other.

19. A mailer according to claim 14 wherein said first and second plies comprise a single sheet of material folded about a foldline such that said plies lie in register one with the other with said intermediate ply therebetween, said return envelope opening being disposed adjacent to but spaced from the foldline in said sheet such that said one ply extends from said envelope opening to said foldline to define a closure flap for said return envelope.

20. A mailer according to claim 19 wherein said closure flap has an adhesive therealong whereby said closure flap may be folded and adhesively secured to the face of said intermediate ply to seal said return envelope.

* * * * *